US009118135B2

(12) United States Patent
Kwak et al.

(10) Patent No.: US 9,118,135 B2
(45) Date of Patent: Aug. 25, 2015

(54) HIGH VOLTAGE CONNECTING TERMINAL FOR POWER SUPPLY

(71) Applicant: Samsung SDI Co., Ltd., Yongin-si, Gyeonggi-do (KR)

(72) Inventors: Eun-Ok Kwak, Yongin-si (KR); Jong-Wook Yoon, Yongin-si (KR)

(73) Assignee: SAMSUNG SDI CO., LTD, Gyeonggi-do (KR)

( * ) Notice: Subject to any disclaimer, the term of this patent is extended or adjusted under 35 U.S.C. 154(b) by 215 days.

(21) Appl. No.: 13/837,211

(22) Filed: Mar. 15, 2013

(65) Prior Publication Data

US 2014/0099825 A1 Apr. 10, 2014

(30) Foreign Application Priority Data

Oct. 10, 2012 (KR) ..... 10-2012-0112133

(51) Int. Cl.

| | |
|---|---|
| ***H01R 13/73*** | (2006.01) |
| ***H01R 13/40*** | (2006.01) |
| ***H01R 13/512*** | (2006.01) |
| ***H01R 13/74*** | (2006.01) |

(52) U.S. Cl.

CPC ..... *H01R 13/40* (2013.01); *H01R 13/512* (2013.01); *H01R 13/748* (2013.01)

(58) Field of Classification Search

USPC ..... 439/559, 564, 565, 562

IPC ..... H01R 13/5202,13/74, 13/745, 13/748, H01R 13/5205, 13/6315, 2201/26

See application file for complete search history.

(56) References Cited

U.S. PATENT DOCUMENTS

| | | | | |
|---|---|---|---|---|
| 3,803,531 | A * | 4/1974 | Sorensen | 439/190 |
| 4,676,575 | A * | 6/1987 | Denlinger et al. | 439/271 |
| 7,214,094 | B2 * | 5/2007 | Kaminski et al. | 439/550 |
| 7,422,486 | B2 * | 9/2008 | Hoff et al. | 439/660 |
| 7,614,910 | B2 * | 11/2009 | Croteau et al. | 439/573 |
| 8,485,844 | B2 * | 7/2013 | Omae et al. | 439/559 |
| 2005/0250006 | A1 | 11/2005 | Kim | |
| 2010/0236623 | A1 | 9/2010 | Kadonaga | |

FOREIGN PATENT DOCUMENTS

| | | | |
|---|---|---|---|
| KR | 2005-0106540 | A | 11/2005 |
| KR | 2010-0106229 | A | 10/2010 |

* cited by examiner

*Primary Examiner* — Hien Vu

(74) *Attorney, Agent, or Firm* — Knobble, Martens, Olson & Bear LLP

(57) ABSTRACT

A high voltage connecting terminal for a power supply with improved insulating properties is disclosed. The high voltage connecting terminal may include a power connecting portion having a base plate mounted at one side of a conducting case in which a first opening and a first fastening hole are formed and a power connecting terminal formed to protrude at one side of the base plate, an insulating member interposed between the conducting case and the power connecting portion and having a third opening and a third fastening hole formed therein, and an insulating gasket mounted at the other side of the conducting case and having a fourth opening and a fourth fastening hole formed therein, the insulating gasket including a protruding portion formed along an outer circumference of the fourth opening so as to pass through the first opening.

6 Claims, 4 Drawing Sheets

HIGH VOLTAGE CONNECTING TERMINAL FOR POWER SUPPLY

CROSS-REFERENCE TO RELATED APPLICATIONS

This application claims priority to and the benefit of Korean Patent Application No. 10-2012-0112133, filed on Oct. 10, 2012, in the Korean Intellectual Property Office, the entire content of which is incorporated herein by reference.

BACKGROUND

1. Field

The present disclosure relates to a high voltage connecting terminal for a power supply, and more particularly, to a high voltage connecting terminal for a power supply, which can improve insulation properties.

2. Description of the Related Technology

In general, an electrical distribution panel is fastened to a high voltage connecting terminal in an energy storage system (ESS) requiring high voltage. When an electrical distribution panel and a high voltage connecting terminal are assembled, the high voltage connecting terminal may be electrically connected to the conductive electrical distribution panel. There are safety concerns, however, if a short circuit occurs in the high voltage connecting terminal.

SUMMARY OF CERTAIN INVENTIVE ASPECTS

In a first aspect, a high voltage connecting terminal for a power supply is disclosed in which an insulating gasket is applied to a fastening structure between the high voltage connecting terminal and a conducting case to improve electrical insulation.

In another aspect, a high voltage connecting terminal for a power supply is disclosed that includes, for example, a power connecting portion having a base plate mounted at one side of a conducting case in which a first opening and a first fastening hole are formed and a power connecting terminal formed to protrude from a side of the base plate, an insulating member which is interposed between the conducting case and the power connecting portion and has a third opening and a third fastening hole formed therein, and an insulating gasket which is mounted at the other side of the conducting case and has a fourth opening and a fourth fastening hole formed therein. In some embodiments, the insulating gasket includes a protruding portion formed to protrude along an outer circumference of the fourth opening so as to pass through the first opening.

In some embodiments, at least one guide groove may be formed in the first opening of the conducting case. In some embodiments, a guide portion passing through the guide groove may be formed at the protruding portion of the insulating gasket. In some embodiments, the second, third and fourth fastening holes are formed at positions corresponding to one another and may be fastened by a single fastening member. In some embodiments, the second, third and fourth fastening holes may have the same size. In some embodiments, the size of the first fastening hole may be greater than that of the second fastening hole. In some embodiments, a through-portion may be formed to protrude along an outer circumference of the fourth fastening hole. In some embodiments, a through-portion may be formed to pass through the first fastening hole. In some embodiments, a component connecting terminal formed to protrude at another side of the base plate may be formed on the power connecting portion.

In another aspect, a high voltage connecting terminal for a power supply is disclosed that is configured to prevent a short circuit between a conducting case and the high voltage connecting terminal by improving the structure of an insulating gasket of the high voltage connecting terminal fastened to the conducting case.

In another aspect, a high voltage connecting terminal for a power supply is disclosed with improved safety characteristics and improved insulation properties.

BRIEF DESCRIPTION OF THE DRAWINGS

The accompanying drawings, together with the specification, illustrate exemplary embodiments, and, together with the description, serve to explain the principles of the present disclosure.

DETAILED DESCRIPTION OF CERTAIN INVENTIVE EMBODIMENTS

Figure 1:
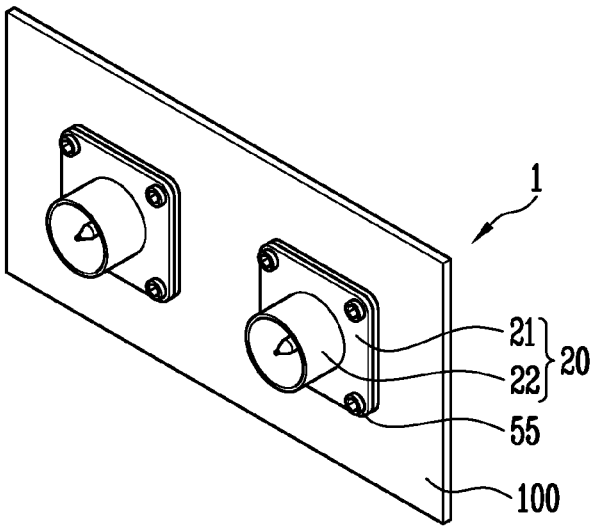
FIG. 1 is a front perspective view illustrating a state in which a high voltage connecting terminal for a power supply is fastened to a conducting case according to an embodiment of the present disclosure.

In the following detailed description, only certain exemplary embodiments have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements. In the drawings, the thickness or size of layers are exaggerated for clarity and not necessarily drawn to scale.

Figure 2:
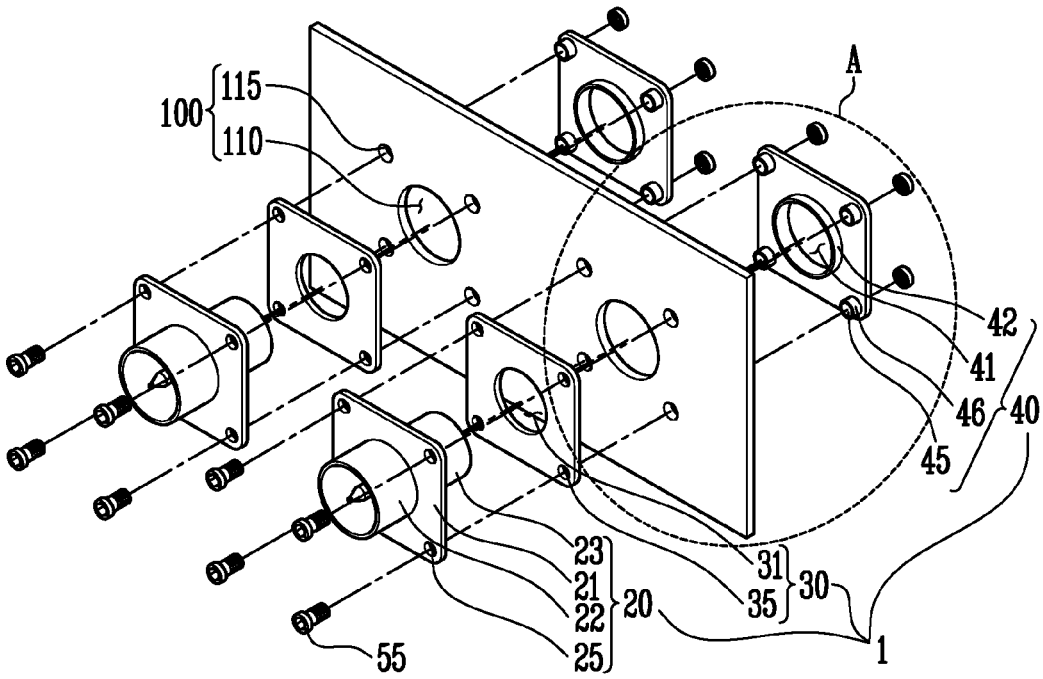
FIG. 2 is an exploded perspective view of FIG. 1.
Figure 3A:
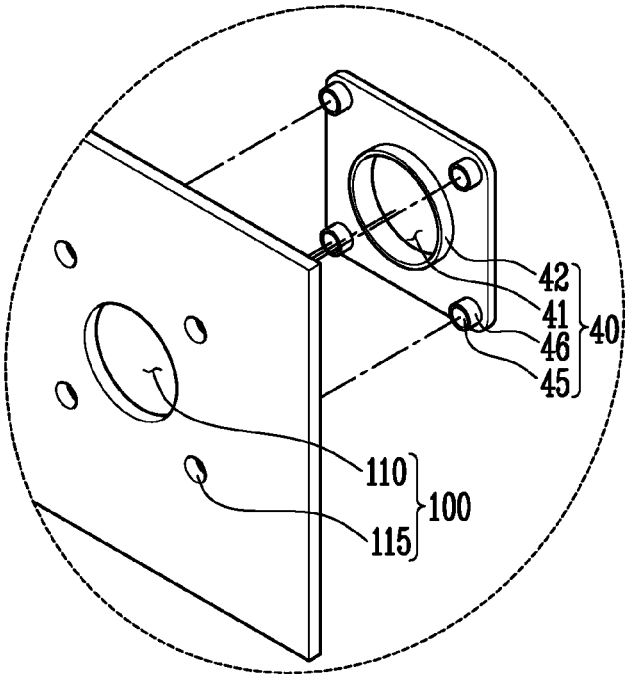
FIG. 3A is a partial enlarged perspective view of portion A of FIG. 2.
Figure 3B:
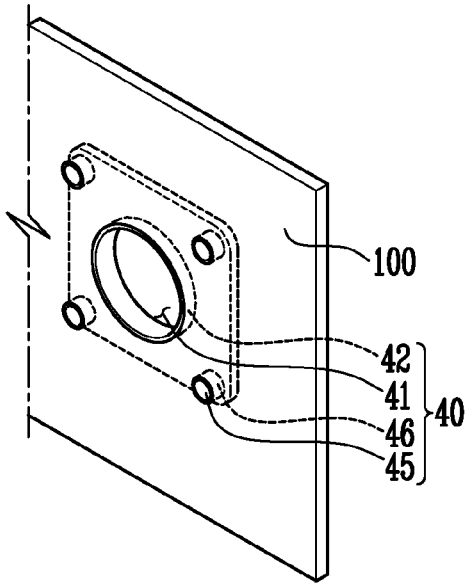
FIG. 3B is an assembled perspective view of FIG. 3A.

FIG. 1 is a front perspective view illustrating a high voltage connecting terminal for a power supply fastened to a conducting case according to an embodiment of the present disclosure. FIG. 2 is an exploded perspective view of FIG. 1. FIG. 3A is a partial enlarged perspective view of portion A of FIG. 2. FIG. 3B is an assembled perspective view of FIG. 3A.

The high voltage connecting terminal 1 includes a power connecting portion 20 having a base plate 21 mounted at one side of a conducting case 100 in which a first opening 110 is formed and a power connecting terminal 22 formed to protrude at one side of the base plate 21, an insulating member 30 interposed between the conducting case 100 and the power connecting portion, and an insulating gasket 40 which is mounted at the other side of the conducting case 100 and has a fourth opening 41 formed therein. A protruding portion 42 is provided to the insulating gasket 40. Here, the protruding portion 42 protrudes along an outer circumference of the fourth opening 41 so as to pass through the first opening 110.

Referring to FIGS. 1 and 2, the first opening 110 and a first fastening hole 115 are formed in the conducting case 100, and a second opening (not shown) and a second fastening hole 25 are formed in the base plate 21 of the power connecting portion 20 mounted at the one side of the conducting case 100. A third opening 31 and a third fastening hole 35 are formed in the insulating member 30 interposed between the conducting case 100 and the power connecting portion 20. A fourth opening 41 and a fourth fastening hole 45 are formed in the insulating gasket 40 mounted at the other side of the conducting case 100. Here, the second, third and fourth fastening holes 25, 35 and 45 formed at positions corresponding to one another are fastened by a single fastening member 55. Meanwhile, the second fastening hole 25, the third fastening hole 35 of the conducting case 100, and the fourth fastening hole 45 may have the same size. The size of the first fastening hole 115 may be greater than that of the second fastening hole 25.

A through-portion 46 formed protruding along an outer circumference of the fourth fastening 45. The through-portion 46 is formed to pass through the first fastening hole 115. Meanwhile, a component connecting terminal 23 formed to protrude at the other side of the base plate 21 is provided to the power connecting portion 20 so as to be connected to another component.

Preferably, the high voltage connecting terminal 1 is provided with at least two high voltage connecting terminals. In some embodiments, the number of high voltage connecting terminals is an even number. For example, as illustrated in this embodiment, if the left high voltage connecting terminal 1 in FIGS. 1 and 2 is a positive (+) electrode terminal, the right high voltage connecting terminal 1 becomes a negative (−) electrode terminal. If the left high voltage connecting terminal 1 in FIGS. 1 and 2 is a positive (−) electrode terminal, the right high voltage connecting terminal 1 becomes a negative (+) electrode terminal. Although it has been described in this embodiment that two high voltage connecting terminals 1 are provided, the present disclosure is not limited thereto.

Referring to FIGS. 2, 3A and 3B, if the high voltage connecting terminal 1 and the conducting case 100 are fastened by the fastening member 55, the protruding portion 42 formed to protrude along the outer circumference of the fourth opening 41 formed in the insulating gasket 40 surrounds the outer circumference of the first opening 110 to which current may be applied by passing through the first opening 110 of the conducting case 100 when the conducting case 100 is fastened to the high voltage connecting terminal 1. The through-portion 46 formed protrude along the outer circumference of the fourth fastening hole 45 formed in the insulating gasket 40 surrounds the outer circumference of the first fastening hole 115 to which current may be applied by passing through the first fastening hole 115 of the conducting case 100 when the conducting case 100 is fastened to the high voltage connecting terminal 1. Thus, a short circuit that may occur between the conducting case 100 and the high voltage connecting terminal 1 can be prevented by changing the structure of the insulating gasket 40 and thereby improving the insulating properties and safety of the high voltage connecting terminal 1.

Figure 4:
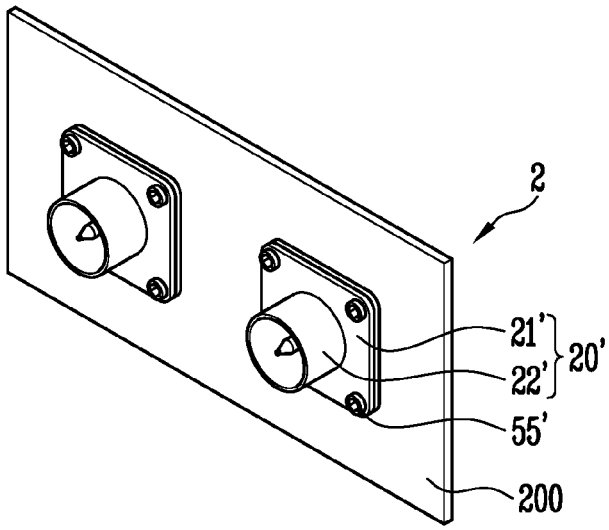
FIG. 4 is a front perspective view illustrating a state in which a high voltage connecting terminal for a power supply is fastened to a conducting case according to another embodiment of the present disclosure.
Figure 5:
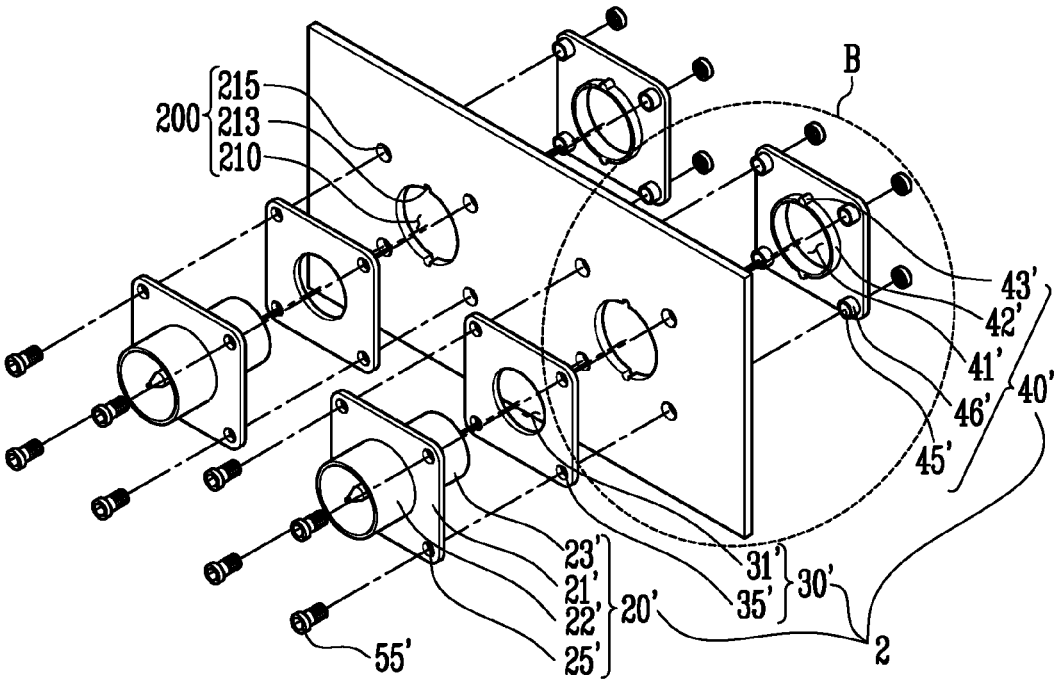
FIG. 5 is an exploded perspective view of FIG. 4.
Figure 6A:
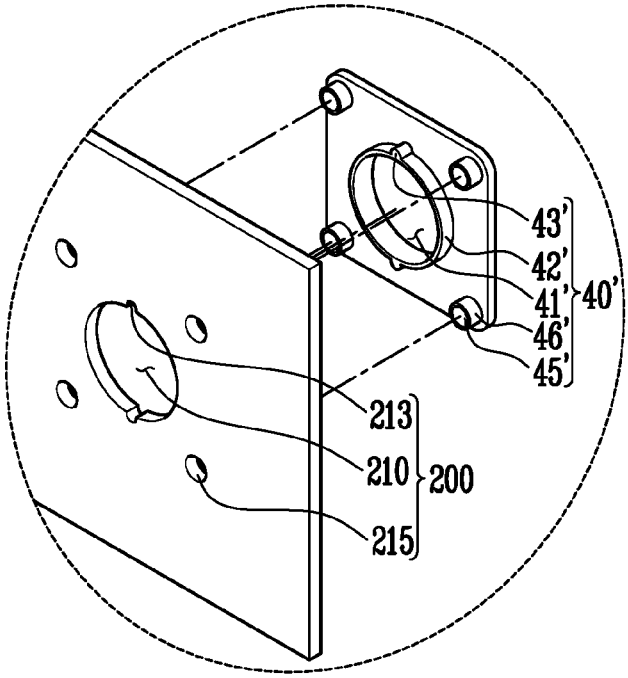
FIG. 6A is a partial enlarged perspective view of portion B of FIG. 5.
Figure 6B:
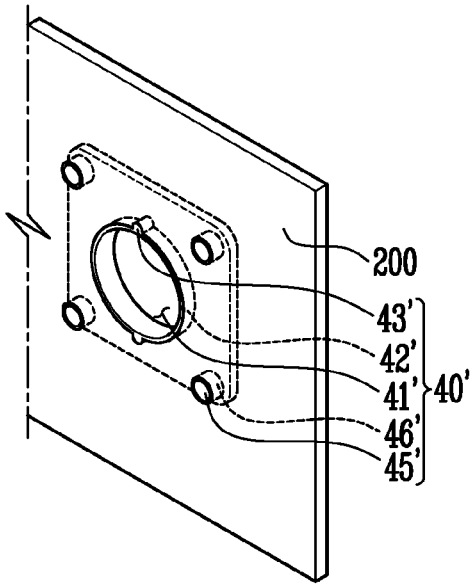
FIG. 6B is an assembled perspective view of FIG. 6A.

FIG. 4 is a front perspective view illustrating a high voltage connecting terminal for a power supply fastened to a conducting case according to another embodiment of the present disclosure. FIG. 5 is an exploded perspective view of FIG. 4. FIG. 6A is a partial enlarged perspective view of portion B of FIG. 5. FIG. 6B is an assembled perspective view of FIG. 6A.

The high voltage connecting terminal 2 includes a power connecting portion 20' having a base plate 21' mounted at one side of a conducting case 200 in which a first opening 210 is formed and a power connecting terminal 22' formed to protrude at one side of the base plate 21', an insulating member 30' interposed between the conducting case 200 and the power connecting portion 20', and an insulating gasket 40' which is mounted at the other side of the conducting case 200 and has a fourth opening 41' formed therein. A protruding portion 42' and a guide portion 43' formed at a portion of the protruding portion 42' are provided to the insulating gasket 40'. Here, the protruding portion 42' is formed to protrude along an outer circumference of the first opening portion 41' so as to pass through the first opening 210. Meanwhile, at least one guide groove 213 is formed in the first opening 210 of the conducting case 200. In this case, the guide portion 43' formed at the protruding portion 42' of the insulating gasket 40' is formed to pass through the guide groove 213.

Referring to FIGS. 4 and 5, the first opening 210 and a first fastening hole 215 are formed in the conducting case 200, and a second opening (not shown) and a second fastening hole 25' are formed in the base plate 21' of the power connecting portion 20' mounted at the one side of the conducting case 200. A third opening 31' and a third fastening hole 35' are formed in the insulating member 30' interposed between the conducting case 200 and the power connecting portion 20'. A fourth opening 41' and a fourth fastening hole 45' are formed in the insulating gasket 40' mounted at the other side of the conducting case 200. Here, the second, third and fourth fastening holes 25', 35' and 45' formed at positions corresponding to one another are fastened by a single fastening member 55'. Meanwhile, the second fastening hole 25' and the third fastening hole 35' of the conducting case 200 and the fourth fastening hole 45' may have the same size. A size of the first fastening hole 215 may be greater than that of the second fastening hole 25'.

A through-portion 46' may be formed to protrude along an outer circumference of the fourth fastening hole 45'. The through-portion 46' may be formed to pass through the first fastening hole 215. Meanwhile, a component connecting terminal 23' formed to protrude at the other side of the base plate 21' is provided to the power connecting portion 20' so as to be connected to another component.

Preferably, the high voltage connecting terminal 2 is provided with at least two high voltage connecting terminals. In some embodiments, the number of high voltage connecting terminals is an even number. For example, as illustrated in this embodiment, if the left high voltage connecting terminal 1 in FIGS. 4 and 5 is a positive (+) electrode terminal, the right high voltage connecting terminal 1 becomes a negative (−) electrode terminal. If the left high voltage connecting terminal 1 in FIGS. 4 and 5 is a positive (−) electrode terminal, the right high voltage connecting terminal 1 becomes a negative (+) electrode terminal. Although it has been described in this embodiment that two high voltage connecting terminals 1 are provided, the present disclosure is not limited thereto.

Referring to FIGS. 5, 6A and 6B, if the high voltage connecting terminal 2 and the conducting case 200 are fastened by the fastening member 55', the protruding portion 42' formed to protrude along the outer circumference of the fourth opening 41' formed in the insulating gasket 40' surrounds the outer circumference of the first opening 210 to which current may be applied by passing through the first opening 210 of the conducting case 200 when the conducting case 200 is fastened to the high voltage connecting terminal 2. The through-portion 46' formed protrude along the outer circumference of the fourth fastening hole 45' formed in the insulating gasket 40' surrounds the outer circumference of the first fastening hole 215 to which current may be applied by passing through the first fastening hole 215 of the conducting case 200 when the conducting case 200 is fastened to the high voltage connecting terminal 2. Thus, a short circuit that may occur between the conducting case 200 and the high voltage connecting terminal 2 can be prevented by changing the structure of the insulating gasket 40' and thereby improving the insulating properties and safety of the high voltage connecting terminal 2.

Meanwhile, unlike the aforementioned embodiment, as described above, the protruding portion 42' and the guide portion 43' formed at the portion of the protruding portion 42' are provided to the insulating gasket 40'. Here, the protruding portion 42' is formed to protrude along the outer circumference of the first opening portion 41' so as to pass through the first opening 210.

In addition, the at least one guide groove 213 is formed in the first opening 210 of the conducting case 200. In this case, the guide portion 43' formed at the protruding portion 42' of the insulating gasket 40' is formed to pass through the guide groove 213. Thus, a short circuit that may occur between the conducting case 200 and the high voltage connecting terminal 2 can be prevented when the disclosed embodiments are used, and the guide groove 213 of the conducting case 200 and the guide portion 43' of the insulating gasket 40' can easily guide the alignment between the conducting case 200 and the insulating gasket 40'. Accordingly, the fastening between the conducting case 200 and the high voltage connecting terminal 2 can be more easily performed.

While the present invention has been described in connection with certain exemplary embodiments, it will be appreciated by those skilled in the art that various modifications and changes may be made without departing from the scope of the present disclosure. It will also be appreciated by those of skill in the art that parts mixed with one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments. With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity. Thus, while the present disclosure has described certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A high voltage connecting terminal for a power supply, comprising:

a power connecting portion having a base plate mounted at one side of a conducting case in which a first opening and a first fastening hole are formed and having a second opening and a second fastening hole formed therein and a power connecting terminal formed outwardly to protrude at one side of the base plate;

an insulating member interposed between the conducting case and the power connecting portion, the insulating member having a third opening and a third fastening hole formed therein; and an insulating gasket mounted at another side of the conducting case opposite the power connection portion, the insulating gasket having a fourth opening and a fourth fastening hole formed therein, and the insulating gasket having a protruding portion formed along an outer circumference of the fourth opening and formed to pass through the first opening, wherein at least one guide groove is formed in the first opening of the conducting case, and wherein a guide portion is formed on the protruding portion of the insulating gasket and formed to mate with and penetrate through the guide groove.

2. The high voltage connecting terminal of claim 1, further comprising a fastening member penetrating the second, third and fourth fastening holes.

3. The high voltage connecting terminal of claim 2, wherein the second, third and fourth fastening holes have the same size, and the size of the first fastening hole is greater than that of the second fastening hole.

4. The high voltage connecting terminal of claim 1, wherein the fourth fastening hole includes a through-position formed to protrude along the outer circumference of the fourth fastening hole.

5. The high voltage connecting terminal of claim 4, wherein the through-portion is formed to pass through the first fastening hole.

6. The high voltage connecting terminal of claim 1, wherein the power connecting portion further includes a component connecting terminal formed to protrude from a side of the base plate opposite the power connecting terminal.

* * * * *